US011530466B2

(12) United States Patent
Sakaguchi et al.

(10) Patent No.: US 11,530,466 B2
(45) Date of Patent: Dec. 20, 2022

(54) LOW THERMAL EXPANSION ALLOY

(71) Applicant: SHINHOKOKU STEEL CORPORATION, Kawagoe (JP)

(72) Inventors: Naoki Sakaguchi, Kawagoe (JP); Haruyasu Ohno, Kawagoe (JP)

(73) Assignee: SHINHOKOKU MATERIAL CORP., Kawagoe (JP)

( * ) Notice: Subject to any disclaimer, the term of this patent is extended or adjusted under 35 U.S.C. 154(b) by 116 days.

(21) Appl. No.: 16/500,569

(22) PCT Filed: Apr. 3, 2018

(86) PCT No.: PCT/JP2018/014319
§ 371 (c)(1),
(2) Date: Nov. 22, 2019

(87) PCT Pub. No.: WO2018/186417
PCT Pub. Date: Oct. 11, 2018

(65) Prior Publication Data

US 2020/0102630 A1 Apr. 2, 2020

(30) Foreign Application Priority Data

Apr. 4, 2017 (JP) ..... JP2017-074651

(51) Int. Cl.

| | |
|---|---|
| ***C22C 19/07*** | (2006.01) |
| ***C22C 1/02*** | (2006.01) |
| ***C22C 30/00*** | (2006.01) |
| ***C22F 1/10*** | (2006.01) |
| ***C22F 1/16*** | (2006.01) |

(52) U.S. Cl.
CPC ..... *C22C 19/07* (2013.01); *C22C 1/02* (2013.01); *C22C 30/00* (2013.01); *C22F 1/10* (2013.01); *C22F 1/16* (2013.01)

(58) Field of Classification Search
USPC ..... 420/440
See application file for complete search history.

(56) References Cited

FOREIGN PATENT DOCUMENTS

| | | | |
|---|---|---|---|
| JP | 2002-88432 | A | 3/2002 |
| JP | 2003-81648 | A | 3/2003 |
| JP | 2004-204255 | A | 7/2004 |
| JP | 2011-74454 | A | 4/2011 |

OTHER PUBLICATIONS

English language machine translation of JP2004204255 to Nishida et al. Generated Jun. 30, 2021. (Year: 2021).*

(Continued)

*Primary Examiner* — Brian D Walck
(74) *Attorney, Agent, or Firm* — Birch, Stewart, Kolasch & Birch, LLP

(57) ABSTRACT

A low thermal expansion alloy having a high rigidity and a low thermal expansion coefficient comprising, by mass %, C: 0.040% or less, Si: 0.25% or less, Mn: 0.15 to 0.50%, Cr: 8.50 to 10.0%, Ni: 0 to 5.00%, and Co: 43.0 to 56.0%, S: 0 to 0.050%, and Se: 0 to 0.050% and having a balance of Fe and unavoidable impurities, the contents of Ni, Co, and Mn represented by [Ni], [Co], and [Mn] satisfying $55.7 \leq 2.2[Ni]+[Co]+1.7[Mn] \leq 56.7$ and the structure being an austenite single phase.

4 Claims, 1 Drawing Sheet

(56) References Cited

OTHER PUBLICATIONS

International Search Report (Fom PCT/ISA/210), dated Jun. 19, 2018, for International Application No. PCT/JP2018/014319, with an English translation.

Preliminary Report on Patentability and Written Opinion of the Intemational Searching Authority (Forms PCT/IB/326, PCT/IB/373 and PCT/ISA/237), dated Oct. 17, 2019, for International Application No. PCT/JP2018/014319, with an English translation.

* cited by examiner (a)
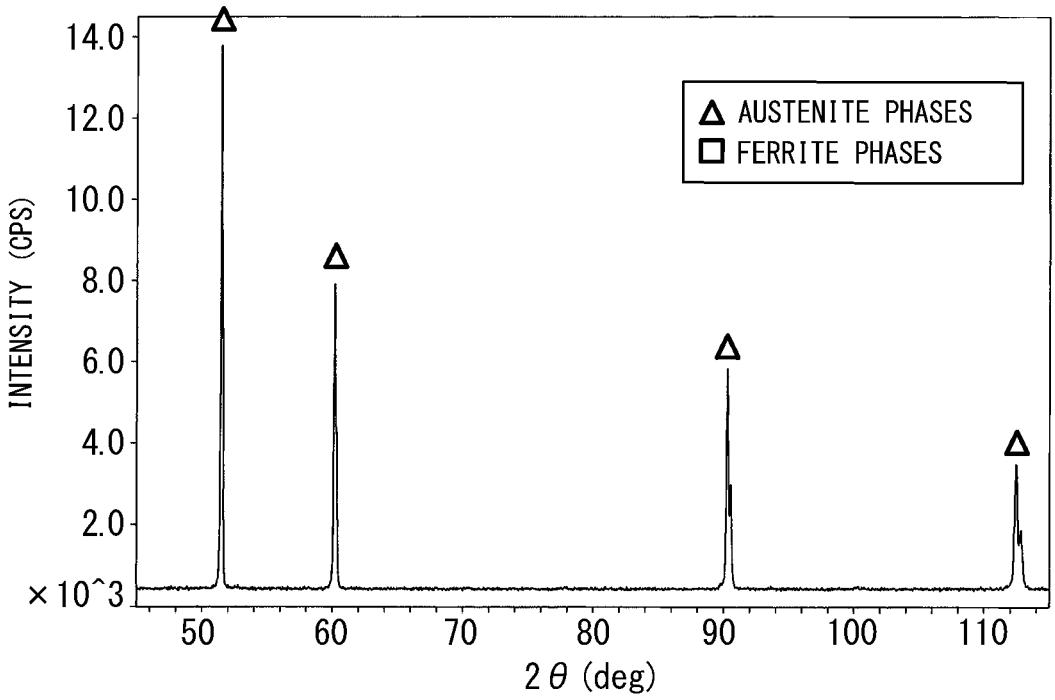
(b)
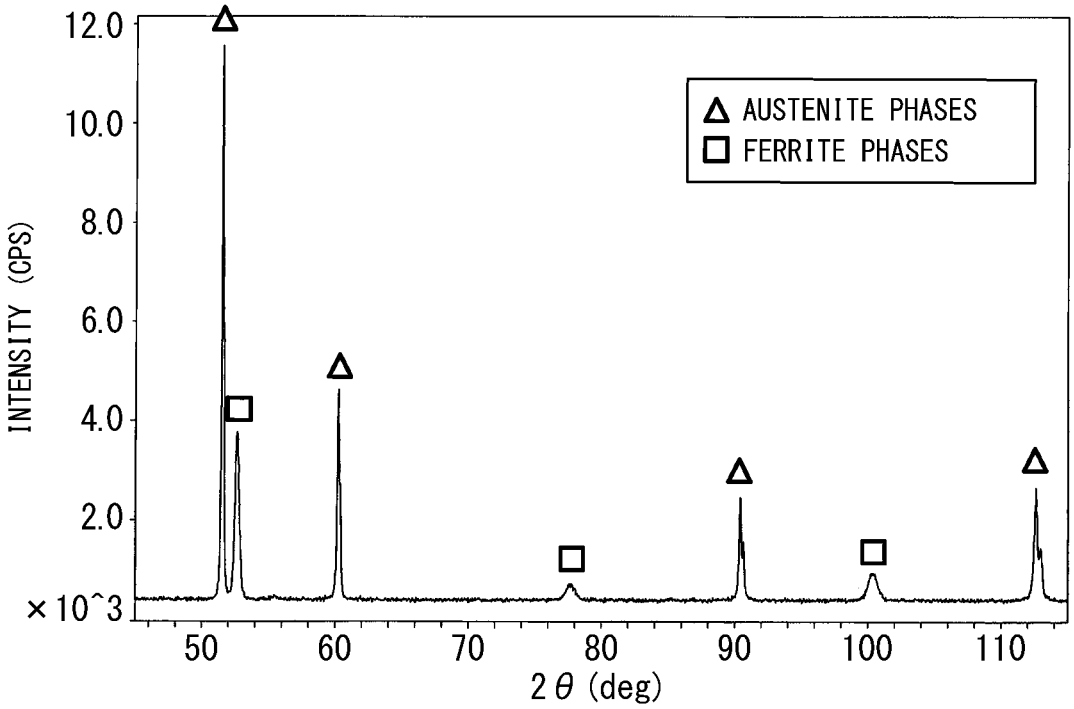

LOW THERMAL EXPANSION ALLOY

FIELD

The present invention relates to a low thermal expansion alloy having a high Young's modulus.

BACKGROUND

As a material for components in electronics and semiconductor related equipment, laser processing machines, and ultraprecision machining equipment, broad use is being made of the thermally stable low thermal expansion alloy. However, in conventional low thermal expansion alloy, there was the problem of the Young's modulus being a small one-half of that of general steel materials. For this reason, it was necessary to make the thickness of the components covered greater and otherwise design the components for higher rigidity.

PTL 1 discloses an alloy having a high elastic modulus and a linear thermal expansion coefficient of 2 to $8\times10^{-6}$/K as a material for a die made of a low expansion Co-based alloy for use for press-forming optical glass lenses excellent in corrosion resistance of glass. This alloy preferably has a single crystalline structure with a [111] crystal orientation aligned with the press axis of the die.

PTL 2 discloses a low expansion Co-based alloy exhibiting an excellent low expansion property equivalent to that near ordinary temperature in an ultralow temperature region of less than −50° C.

CITATIONS LIST

Patent Literature

[PTL 1] Japanese Unexamined Patent Publication No. 2003-81648

[PTL 2] Japanese Unexamined Patent Publication No. 2011-74454

SUMMARY

Technical Problem

The alloy disclosed in PTL 1 has a relatively low thermal expansion coefficient of 2 to $8\times10^{-6}$/K, but a further lower thermal expansion coefficient is sought for use as a material for a component of ultraprecision machining equipment. Further, the alloy disclosed in PTL 1 is single crystalline, so there is the defect that time is taken for production.

The alloy disclosed in PTL 2 exhibits an excellent thermal expansion property in the ultralow temperature region below −50° C., but the structure becomes a three-phase structure, so becomes unstable. Martensite transformation is started at −150° C. or less and the thermal expansion property is lost, so the temperature environment in which use is possible is limited. For example, there is a problem in design for ultralow temperature use for temperatures of use for precision equipment such as the recent radio telescopes in extremely cold regions or the lunar surface.

The present invention has as its object to solve the above problem and provide a low thermal expansion alloy able to be produced by usual casting, having a high Young's modulus and low thermal expansion coefficient, and further having a structure stable even at a cryogenic temperature and provide a method for producing the same.

Solution to Problem

The inventors studied in depth a method of obtaining a low thermal expansion alloy achieving both a high Young's modulus and low thermal expansion coefficient and further having a structure stable even at a cryogenic temperature. As a result, they discovered that, in particular, by optimizing the contents of Ni, Co, and Mn, it is possible to obtain a low thermal expansion alloy having both a high Young's modulus and a low thermal expansion coefficient and further stable at a cryogenic temperature as well.

In a usual low thermal expansion alloy as well, it is possible to adjust the chemical composition to adjust the Young's modulus and the thermal expansion coefficient to a certain extent. However, the Young's modulus and thermal expansion coefficient are substantially in a tradeoff relationship. That is, in this relationship, if the Young's modulus becomes higher, the thermal expansion coefficient also becomes larger. With a conventional Fe—Ni or Fe—Ni—Co alloy, there were limits to increasing the Young's modulus.

The inventors discovered that in a low thermal expansion alloy, by optimizing the chemical composition of an Fe—Co—Cr alloy, the Young's modulus is improved even with a small thermal expansion coefficient. Further, they discovered that since austenite has a stable structure even at a cryogenic temperature of −196° C. or less, martensite transformation does not proceed and the low thermal expansion property is not lost even in extremely cold regions and extremely low temperature usage environments.

The present invention was made based on the above discoveries and has as its gist the following:

(1) A low thermal expansion alloy comprising, by mass %, C: 0.040% or less, Si: 0.25% or less, Mn: 0.15 to 0.50%, Cr: 8.50 to 10.0%, Ni: 0 to 5.00%, Co: 43.0 to 56.0%, S: 0 to 0.050%, and Se: 0 to 0.050% and having a balance of Fe and unavoidable impurities, contents of Ni, Co, and Mn represented by [Ni], [Co], and [Mn] satisfying $55.7\leq2.2[Ni]+[Co]+1.7[Mn]\leq56.7$ and a structure being an austenite single phase.

(2) A method for producing the low thermal expansion alloy according to (1), comprising heating to 700 to 1050° C., then cooling in a furnace an alloy comprising C: 0.040% or less, Si: 0.25% or less, Mn: 0.15 to 0.50%, Cr: 8.50 to 10.0%, Ni: 0 to 5.00%, Co: 43.0 to 56.0%, S: 0 to 0.050%, and Se: 0 to 0.050% and having a balance of Fe and unavoidable impurities, contents of Ni, Co, and Mn represented by [Ni], [Co], and [Mn] satisfying $55.7\leq2.2[Ni]+[Co]+1.7[Mn]\leq56.7$.

Advantageous Effects of Invention

According to the present invention, a low thermal expansion alloy having a high Young's modulus and low thermal expansion coefficient and further having a structure stable even at a cryogenic temperature is obtained, so can be applied to a component which is required to be thermally stable and high in rigidity.

BRIEF DESCRIPTION OF DRAWINGS

FIG. 1 shows examples of X-ray diffraction of alloys produced by the examples, in which (a) shows an invention example and (b) shows a comparative example.

DESCRIPTION OF EMBODIMENTS

Below, the present invention will be explained in detail. Below, the "%" relating to the chemical composition shall indicate "mass %" unless otherwise indicated. First, the chemical composition of the alloy of the present invention will be explained.

C contributes to improvement of the low temperature stability of austenite, but if the content of C becomes large, the, thermal expansion coefficient becomes larger, the ductility falls, and further the dimensional stability change of the alloy becomes greater, so the content is made 0.040% or less, preferably 0.020% or less. C is not an essential element and need not be included.

Si is added as a deoxidizing material. The solidified alloy does not have to contain Si, but realistically it is difficult to make the content zero. 0.01% or more may be contained. If the amount of Si becomes larger, the thermal expansion coefficient increases, so the amount of Si is made 0.25% or less, preferably is made 0.20% or less. To improve the fluidity of the melt, Si is preferably contained in 0.10% or more.

Mn is added as a deoxidizing material. Further, it also contributes to improvement of the strength by solid solution strengthening. Furthermore, in the present invention, it contributes to improvement of the low temperature stability of the austenite and prevents martensite transformation even at −196° C. To obtain this effect, Mn is included in 0.15% or more. Even if the content of Mn exceeds 0.50%, the effect decreases and the cost becomes high, so the amount of Mn is made 0.50% or less. Preferably, the amount is made 0.30% or less.

Cr is an element important for securing corrosion resistance. Further, by optimal combination with Co, low thermal expansion is obtained. To secure corrosion resistance, the content of Cr is made 8.50% or more. If the amount of Cr becomes too great, the thermal expansion coefficient becomes larger, so the amount of Cr is made 10.0% or less.

Ni contributes to a reduction of the thermal expansion coefficient by combination with Co. Further, it contributes to improvement of the low temperature stability of austenite and prevents martensite transformation even at −196° C. To obtain the desired thermal expansion coefficient, the range of Ni is made 0 to 5.00%, preferably 1.50 to 5.00%.

Co is an essential element lowering the thermal expansion coefficient. If the amount of Co is too large or too small, the thermal expansion coefficient will not become sufficiently small. In the present invention, the amount of Co is made 43.0 to 56.0% in range. The preferable lower limit is 45.0%, while the more preferable lower limit is 48.0%. The preferable upper limit is 54.0%, while the more preferable upper limit is 52.0%.

The low thermal expansion alloy of the present invention has stable austenite and an austenite single-phase structure. This structure is obtained by making the balance of Ni and Co and further Mn a suitable range and can lower the thermal expansion coefficient. To obtain an austenite single-phase structure and low thermal expansion coefficient, the contents (mass %) of Ni, Co, and Mn represented by [Ni], [Co], and [Mn] are made to satisfy $55.7 \leq 2.2[Ni]+[Co]+1.7[Mn] \leq 56.7$.

Whether the structure is an austenite single phase can be investigated by X-ray diffraction. In the present invention, if finding the ratio of intensities of austenite and ferrite in an X-ray diffraction pattern and there is no peak of ferrite or if the intensity of the austenite is 100 times or more of the intensity of the ferrite, it is judged that the structure is an austenite single phase.

In addition, if machinability is demanded, S or Se may be added in a range of 0.050% or less.

The balance of the chemical composition is Fe and unavoidable impurities. The "unavoidable impurities" mean elements which are unavoidably mixed in from the starting materials or production environment etc. at the time of industrial production of steel having the chemical compositions prescribed in the present invention. Specifically, Al, S, P, Cu, etc. may be mentioned. The contents when these elements are unavoidably mixed in are 0.01% or less or so.

Next, a method for producing a low thermal expansion alloy of the present invention will be explained.

The casting mold used for production of the high rigidity, low thermal expansion alloy of the present invention, the apparatus for injection of the molten steel into the casting mold, and the method of injection are not particularly limited. Known apparatuses and methods may be used.

The obtained cast steel or forged steel obtained by forging at 1100° C. is heated to 700 to 1050° C., held there for 0.5 to 5 hr, then cooled in the furnace. A slower cooling rate is preferable. 10° C./min or less is preferable, while 5° C./min or less is more preferable.

The high rigidity, low thermal expansion alloy of the present invention has a high Young's modulus and low thermal expansion coefficient and further has a structure stable at even a cryogenic temperature. Specifically, it has a 160 GPa or more, preferably a 170 GPa or more Young's modulus and a within $\pm 1.0\times10^{-6}$/° C., preferably a within $\pm 0.5\times10^{-6}$/° C. thermal expansion coefficient and has a martensite transformation point lower than −196° C., preferably lower than −269° C.

EXAMPLES

Example 1

Melts adjusted to give chemical compositions shown in Table 1 were poured into casting molds to produce cast steels. The cast steels were made sizes of φ100×350 and were heat treated at 1000° C.×2 hr, cooled in the furnace, and cut out to the sizes of the respective test pieces to obtain test pieces. The produced test pieces were heat treated at 315° C. for 2 hr to obtain the final alloys.

TABLE 1

| | Chemical composition (mass %) | | | | | | | | | | Coefficient | | | | | |
|---|---|---|---|---|---|---|---|---|---|---|---|---|---|---|---|---|
| Ex. | C | Si | Mn | Cr | Ni | Co | S | Se | 2.2Ni + Co + 1.7Mn | Fe | of heat expansion (ppm/° C.) | Young's modulus (GPa) | Austenite Rate (%) | −196° C. structural stability | −269° C. structural stability | |
| 1 | 0.061 | 0.17 | 0.22 | 9.21 | 1.93 | 51.4 | | | 56.0 | Bal. | 3.01 | 166 | 100 | Good | Good | Comp. ex. |
| 2 | 0.004 | 0.35 | 0.20 | 9.22 | 1.89 | 51.3 | | | 55.8 | Bal. | 1.20 | 176 | 98 | Poor | — | Comp. ex. |
| 3 | 0.007 | 0.15 | 0.61 | 9.20 | 1.93 | 51.4 | | | 56.7 | Bal. | 3.03 | 170 | 100 | Good | Good | Comp. ex. |
| 4 | 0.008 | 0.17 | 0.47 | 9.23 | 1.89 | 50.7 | | | 55.7 | Bal. | 0.36 | 176 | 100 | Good | Good | Inv. ex. |
| 5 | 0.006 | 0.12 | 0.17 | 10.6 | 1.93 | 51.4 | | | 55.9 | Bal. | 1.89 | 177 | 77 | Poor | — | Comp. ex. |

TABLE 1-continued

| Ex. | Chemical composition (mass %) C | Si | Mn | Cr | Ni | Co | S | Se | 2.2Ni + Co + 1.7Mn | Fe | Coefficient of heat expansion (ppm/° C.) | Young's modulus (GPa) | Austenite Rate (%) | −196° C. structural stability | −269° C. structural stability | |
|---|---|---|---|---|---|---|---|---|---|---|---|---|---|---|---|---|
| 6 | 0.005 | 0.14 | 0.21 | 7.81 | 1.89 | 51.3 | | | 55.8 | Bal. | 2.64 | 155 | 100 | Good | Good | Comp. ex. |
| 7 | 0.004 | 0.18 | 0.24 | 9.22 | 5.30 | 43.0 | | | 55.1 | Bal. | 1.20 | 148 | 100 | Good | Good | Comp. ex. |
| 8 | 0.004 | 0.14 | 0.14 | 9.23 | 4.92 | 42.9 | | | 54.0 | Bal. | 4.92 | 180 | 57 | Poor | — | Comp. ex. |
| 9 | 0.006 | 0.15 | 0.23 | 9.19 | 4.80 | 44.1 | | | 55.1 | Bal. | 0.79 | 179 | 86 | Poor | — | Comp. ex. |
| 10 | 0.006 | 0.17 | 0.19 | 9.21 | 4.81 | 44.4 | | | 55.3 | Bal. | 0.29 | 181 | 94 | Poor | — | Comp. ex. |
| 11 | 0.007 | 0.18 | 0.23 | 9.24 | 4.82 | 44.7 | | | 55.7 | Bal. | 0.33 | 177 | 100 | Good | Good | Inv. ex. |
| 12 | 0.006 | 0.12 | 0.20 | 9.20 | 4.80 | 45.1 | | | 56.0 | Bal. | 0.39 | 178 | 100 | Good | Good | Inv. ex. |
| 13 | 0.004 | 0.16 | 0.20 | 9.22 | 4.80 | 45.4 | | | 56.3 | Bal. | 0.46 | 178 | 100 | Good | Good | Inv. ex. |
| 14 | 0.004 | 0.15 | 0.20 | 9.20 | 4.80 | 45.9 | | | 56.8 | Bal. | 1.61 | 169 | 100 | Good | Good | Comp. ex. |
| 15 | 0.003 | 0.12 | 0.21 | 9.10 | 1.98 | 50.0 | | | 54.7 | Bal. | 3.46 | 178 | 66 | Poor | — | Comp. ex. |
| 16 | 0.006 | 0.14 | 0.19 | 9.11 | 1.93 | 50.4 | | | 55.0 | Bal. | 0.32 | 174 | 72 | Poor | — | Comp. ex. |
| 17 | 0.008 | 0.12 | 0.18 | 9.14 | 1.95 | 50.7 | | | 55.3 | Bal. | 0.80 | 177 | 88 | Poor | — | Comp. ex. |
| 18 | 0.007 | 0.15 | 0.17 | 9.10 | 1.88 | 51.0 | | | 55.4 | Bal. | 0.34 | 177 | 96 | Poor | — | Comp. ex. |
| 19 | 0.007 | 0.14 | 0.23 | 9.19 | 1.90 | 51.3 | | | 55.9 | Bal. | 0.44 | 177 | 100 | Good | Good | Inv. ex. |
| 20 | 0.005 | 0.16 | 0.22 | 9.06 | 1.96 | 51.7 | | | 56.4 | Bal. | 0.48 | 178 | 100 | Good | Good | Inv. ex. |
| 21 | 0.011 | 0.11 | 0.22 | 9.09 | 1.82 | 52.0 | | | 56.4 | Bal. | 0.46 | 176 | 100 | Good | Good | Inv. ex. |
| 22 | 0.010 | 0.14 | 0.22 | 9.08 | 1.92 | 52.5 | | | 57.1 | Bal. | 1.02 | 177 | 100 | Good | Good | Comp. ex. |
| 23 | 0.012 | 0.14 | 0.22 | 8.98 | 1.94 | 53.0 | | | 57.6 | Bal. | 1.39 | 174 | 100 | Good | Good | Comp. ex. |
| 24 | 0.023 | 0.04 | 0.19 | 9.18 | 1.02 | 52.1 | | | 54.7 | Bal. | 5.02 | 166 | 61 | Poor | — | Comp. ex. |
| 25 | 0.021 | 0.02 | 0.17 | 9.16 | 1.04 | 52.4 | | | 55.0 | Bal. | 0.89 | 171 | 70 | Poor | — | Comp. ex. |
| 26 | 0.016 | 0.03 | 0.17 | 9.20 | 1.00 | 52.7 | | | 55.2 | Bal. | −0.15 | 170 | 76 | Poor | — | Comp. ex. |
| 27 | 0.023 | 0.04 | 0.18 | 9.22 | 1.03 | 53.0 | | | 55.6 | Bal. | 0.08 | 159 | 89 | Poor | — | Comp. ex. |
| 28 | 0.018 | 0.02 | 0.18 | 9.19 | 0.99 | 53.3 | | | 55.8 | Bal. | 0.63 | 169 | 100 | Good | Poor | Inv. ex. |
| 29 | 0.016 | 0.03 | 0.18 | 9.20 | 1.00 | 53.6 | | | 56.1 | Bal. | 0.84 | 166 | 100 | Good | Good | Inv. ex. |
| 30 | 0.019 | 0.04 | 0.18 | 9.22 | 1.01 | 53.9 | | | 56.4 | Bal. | 0.84 | 164 | 100 | Good | Good | Inv. ex. |
| 31 | 0.021 | 0.05 | 0.16 | 9.24 | 0.98 | 54.2 | | | 56.6 | Bal. | 0.97 | 166 | 100 | Good | Good | Inv. ex. |
| 32 | 0.022 | 0.03 | 0.18 | 9.20 | 1.01 | 54.5 | | | 57.0 | Bal. | 2.25 | 156 | 100 | Good | Good | Comp. ex. |
| 33 | 0.020 | 0.04 | 0.05 | 8.86 | — | 54.9 | | | 55.0 | Bal. | 6.50 | 183 | 52 | Poor | — | Comp. ex. |
| 34 | 0.021 | 0.05 | 0.18 | 9.01 | — | 55.2 | | | 55.5 | Bal. | 0.60 | 184 | 88 | Poor | — | Comp. ex. |
| 35 | 0.022 | 0.05 | 0.18 | 8.99 | — | 55.8 | | | 56.1 | Bal. | 0.57 | 172 | 100 | Good | Poor | Inv. ex. |
| 36 | 0.019 | 0.06 | 0.17 | 9.04 | — | 56.1 | | | 56.4 | Bal. | 1.13 | 155 | 100 | Good | Poor | Comp. ex. |
| 37 | 0.018 | 0.07 | 0.16 | 9.00 | — | 57.5 | | | 57.8 | Bal. | 3.06 | 148 | 100 | Good | Poor | Comp. ex. |
| 38 | 0.018 | 0.05 | 0.22 | 9.08 | 1.98 | 51.1 | 0.028 | 0.036 | 55.8 | Bal. | 0.32 | 175 | 100 | Good | Good | Inv. ex. |

The produced test pieces were measured for Young's modulus, thermal expansion coefficient, austenite fraction, and structural stabilities at −196° C. and −269° C.

The Young's modulus was measured at room temperature by the two-point support horizontal resonance method. The thermal expansion coefficient was found using a thermal expansion measuring apparatus as the mean thermal expansion coefficient from 0 to 60° C. The austenite fraction was found using X-ray diffraction using the ratio of intensities of austenite and ferrite.

FIG. 1 shows examples of X-ray diffraction. (a) shows Example 19 (invention example) and (b) shows Example 15 (comparative example).

The structural stability at −196° C. was found by cooling a test piece down to −196° C. and −269° C., holding it there for 1 hour, then examining the structure. The presence of any martensite was observed. A case where no martensite was observed at any of the temperatures was evaluated as "Good" in structural stability, while a case where martensite was observed was evaluated as "Poor" in structural stability.

The results are shown in Table 1. As shown in Table 1, the results are that the alloys of the invention examples have low thermal expansion coefficients of $1\times10^{-6}$/° C. or less, have high Young's moduli of 160 GPa or more, and further have structures comprised of austenite and are stable in structures even at −196° C.

Example 2

Melts adjusted to give chemical compositions shown in Table 2 were poured into φ100×350 casting molds. The cast ingots were heated to 1150° C., then forged to obtain φ50 forged steels, then were heat treated at 1000° C.×2 hr, cooled in the furnace, and cut out to the sizes of the respective test pieces to obtain test pieces. Further, the heat treatments of Examples 39 and 40 were performed diffusion treatment at 1200° C. before forging, heat treatment at 800° C. for 2 hr and water cooling after forging. The steels were cut out to the sizes of the respective test pieces to obtain test pieces. The produced test pieces were heat treated at 315° C. for 2 hr to obtain the final alloys.

TABLE 2

| Ex. | Chemical composition (mass %) C | Si | Mn | Cr | Ni | Co | 2.2Ni + Co + 1.7Mn | Fe | Coefficient of heat expansion (ppm/° C.) | Young's modulus (GPa) | Austenite Rate (%) | −196° C. structural stability | −269° C. structural stability | |
|---|---|---|---|---|---|---|---|---|---|---|---|---|---|---|
| 4-2 | 0.008 | 0.17 | 0.47 | 9.23 | 1.89 | 50.7 | 55.7 | Bal. | 0.33 | 177 | 100 | Good | Good | Inv. ex. |
| 10-2 | 0.006 | 0.17 | 0.19 | 9.21 | 4.81 | 44.4 | 55.3 | Bal. | 0.38 | 182 | 89 | Poor | — | Comp. ex. |
| 12-2 | 0.006 | 0.12 | 0.20 | 9.20 | 4.80 | 45.1 | 56.0 | Bal. | 0.37 | 177 | 100 | Good | Good | Inv. ex. |

TABLE 2-continued

| Ex. | Chemical composition (mass %) C | Si | Mn | Cr | Ni | Co | 2.2Ni + Co + 1.7Mn | Fe | Coefficient of heat expansion (ppm/° C.) | Young's modulus (GPa) | Austenite Rate (%) | −196° C. structural stability | −269° C. structural stability | |
|---|---|---|---|---|---|---|---|---|---|---|---|---|---|---|
| 13-2 | 0.004 | 0.16 | 0.20 | 9.22 | 4.80 | 45.4 | 56.3 | Bal. | 0.51 | 178 | 100 | Good | Good | Inv. ex. |
| 14-2 | 0.004 | 0.15 | 0.20 | 9.20 | 4.80 | 45.9 | 56.8 | Bal. | 1.42 | 171 | 100 | Good | Good | Comp. ex. |
| 18-2 | 0.007 | 0.15 | 0.17 | 9.10 | 1.88 | 51.0 | 55.4 | Bal. | 0.29 | 178 | 93 | Poor | — | Comp. ex. |
| 19-2 | 0.007 | 0.14 | 0.23 | 9.19 | 1.90 | 51.3 | 55.9 | Bal. | 0.40 | 176 | 100 | Good | Good | Inv. ex. |
| 20-2 | 0.005 | 0.16 | 0.22 | 9.06 | 1.96 | 51.7 | 56.4 | Bal. | 0.48 | 178 | 100 | Good | Good | Inv. ex. |
| 21-2 | 0.011 | 0.11 | 0.22 | 9.09 | 1.82 | 52.0 | 56.4 | Bal. | 0.47 | 175 | 100 | Good | Good | Inv. ex. |
| 22-2 | 0.010 | 0.14 | 0.22 | 9.08 | 1.92 | 52.5 | 57.1 | Bal. | 1.22 | 179 | 100 | Good | Good | Comp. ex. |
| 28-2 | 0.018 | 0.02 | 0.18 | 9.19 | 0.99 | 53.3 | 55.8 | Bal. | 0.59 | 172 | 100 | Good | Poor | Inv. ex. |
| 29-2 | 0.016 | 0.03 | 0.18 | 9.20 | 1.00 | 53.6 | 56.1 | Bal. | 0.77 | 171 | 100 | Good | Good | Inv. ex. |
| 31-2 | 0.021 | 0.05 | 0.16 | 9.24 | 0.98 | 54.2 | 56.6 | Bal. | 0.99 | 169 | 100 | Good | Good | Inv. ex. |
| 34-2 | 0.021 | 0.05 | 0.18 | 9.01 | — | 55.2 | 55.5 | Bal. | 0.62 | 183 | 89 | Poor | — | Comp. ex. |
| 35-2 | 0.022 | 0.05 | 0.18 | 8.99 | — | 55.8 | 56.1 | Bal. | 0.44 | 170 | 100 | Good | Poor | Inv. ex. |
| 39 | 0.018 | 0.33 | 0.35 | — | 36.21 | — | 80.3 | Bal. | 1.32 | 140 | 100 | Good | Good | Comp. ex. |
| 40 | 0.009 | 0.15 | 0.22 | — | 32.18 | 5.21 | 76.4 | Bal. | −0.01 | 135 | 100 | Poor | — | Comp. ex. |

The results are shown in Table 2. As shown in Table 2, the results are that the alloys of the invention examples have low thermal expansion coefficients of $1\times10^{-6}$/° C. or less, have high Young's moduli of 160 GPa or more, and further have structures comprised of austenite and are stable in structures even at −196° C.

The invention claimed is:

1. An alloy comprising, by mass %,

C: 0.040% or less,

Si: 0.25% or less,

Mn: 0.15 to 0.50%,

Cr: 8.50 to 10.0%,

Ni: 0 to 5.00%,

Co: 43.0 to 54.2%,

S: 0 to 0.050%,

Se: 0 to 0.050% and a balance of Fe and unavoidable impurities, contents of Ni, Co, and Mn represented by [Ni], [Co], and [Mn] satisfying $$55.7\leq 2.2[Ni]+[Co]+1.7[Mn]\leq 56.7,$$

a structure of the alloy being an austenite single phase, wherein the alloy has a thermal expansion coefficient of $-1.0\times10^{-6}$/° C. to $+1.0\times10^{-6}$/° C.

2. The alloy according to claim 1, wherein the alloy comprises 43.0 to 54.0% of Co, by mass %.

3. The alloy according to claim 1, wherein the alloy comprises 43.0 to 52.0% of Co, by mass %.

4. A method for producing the alloy according to claim 1, comprising the steps of:

heating an alloy to 700 to 1050° C., the alloy comprising:

C: 0.040% or less,

Si: 0.25% or less,

Mn: 0.15 to 0.50%,

Cr: 8.50 to 10.0%,

Ni: 0 to 5.00%,

Co: 43.0 to 54.2%,

S: 0 to 0.050%, and

Se: 0 to 0.050% and having a balance of Fe and unavoidable impurities, contents of Ni, Co, and Mn represented by [Ni], [Co], and [Mn] satisfying $$55.7\leq 2.2[Ni]+[Co]+1.7[Mn]\leq 56.7;$$

cooling the alloy in a furnace.

* * * * *